US006217788B1

(12) United States Patent
Wucherer et al.

(10) Patent No.: US 6,217,788 B1
(45) Date of Patent: Apr. 17, 2001

(54) FIRE SUPPRESSION COMPOSITION AND DEVICE

(75) Inventors: Edward J. Wucherer, Bothell; Gary F. Holland, Snohomish, both of WA (US)

(73) Assignee: Primex Aerospace Company, Redmond, WA (US)

( * ) Notice: Subject to any disclaimer, the term of this patent is extended or adjusted under 35 U.S.C. 154(b) by 0 days.

(21) Appl. No.: 09/504,599

(22) Filed: Feb. 15, 2000

Related U.S. Application Data

(60) Provisional application No. 60/120,669, filed on Feb. 19, 1999.

(51) Int. Cl.[7] ..... A62D 1/06; C06B 45/04; C06B 31/32; C06B 31/12; C06B 29/02

(52) U.S. Cl. ..... 252/5; 252/2; 252/4; 252/7; 149/17; 149/47; 149/62; 149/77; 149/78

(58) Field of Search ..... 252/2, 4, 5, 7; 149/17, 47, 62, 77, 78, 46, 61, 76; 169/12, 26, 84, 61, 62

(56) References Cited

U.S. PATENT DOCUMENTS

| | | | | |
|---|---|---|---|---|
| 4,601,344 | | 7/1986 | Reed, Jr. et al. | 169/47 |
| 5,113,947 | | 5/1992 | Robin | 169/46 |
| 5,117,917 | | 6/1992 | Robin | 169/46 |
| 5,124,053 | | 6/1992 | Iikubo | 252/8 |
| 5,423,384 | | 6/1995 | Galbraith et al. | 169/12 |
| 5,465,795 | | 11/1995 | Galbraith et al. | 169/11 |
| 5,609,210 | | 3/1997 | Galbraith et al. | 169/26 |
| 5,613,562 | | 3/1997 | Galbraith et al. | 169/12 |
| 5,661,261 | * | 8/1997 | Ramaswamy et al. | 149/36 |
| 5,756,006 | | 5/1998 | Reed, Jr. | 252/408.1 |
| 5,844,164 | * | 12/1998 | Cabrern | 102/288 |
| 5,861,571 | * | 1/1999 | Scheffee et al. | 102/288 |
| 6,019,861 | * | 2/2000 | Canterberry et al. | 149/19.1 |
| 6,024,889 | * | 2/2000 | Holland et al. | 252/5 |
| 6,045,637 | * | 4/2000 | Grzyll | 149/19.3 |
| 6,045,726 | * | 4/2000 | Williams et al. | 252/602 |

* cited by examiner

*Primary Examiner*—Joseph D. Anthony
(74) *Attorney, Agent, or Firm*—Todd E. Garabedian; Wiggin & Dana

(57) ABSTRACT

The present invention is directed to a fire suppression composition, comprising a propellant comprising a fuel and an oxidizer, said propellant capable of generating inert gas; and a fire suppression additive selected from the group consisting of iron-containing compounds, non-halide potassium salts, and combinations thereof. Useful iron-containing compounds include ferric oxide, ferric carbonate, ferric oxalate, and iron cyanide dyes. Useful potassium salts include potassium acetate, potassium acetylacetonate, potassium bicarbonate, and potassium carbonate. The invention is also directed to a fire suppression apparatus that utilizes the above fire suppression composition.

18 Claims, 2 Drawing Sheets

FIRE SUPPRESSION COMPOSITION AND DEVICE

This application claims the benefit of Provisional Application Serial No. 60/120,669 filed on Feb. 19, 1999.

BACKGROUND OF THE INVENTION

1. Field of the Invention

The present invention is directed to fire suppression compositions and devices, and more particularly to a fire suppression composition and device that utilizes iron-containing species and/or non-halide potassium salts as environmentally innocuous, chemically acting fire suppression additives.

2. Brief Description of the Related Art

The majority of fire extinguishing systems used today, in applications such as commercial and military aircraft, ground vehicles (autos, trucks, buses), and surface ships, rely on the chemical agents generally known as Halons. Halons are materials generally composed of brominated or chlorinated fluorocarbon compounds. Examples of common Halons include Halon-1301 ($CF_3Br$) and Halon-1211 ($CF_2ClBr$). Halons have been shown to depend upon a combination of (1) chemical effectiveness (e.g., quenching of reactive chemical radical intermediates associated with the combustion process), and (2) physical effectiveness (e.g., cooling the combustion flame and dilution of the combustion ingredients). This effective combination of fire suppressive characteristics have led to a wide use of Halons as a firefighting composition.

Recently, international cooperation has resulted in an agreement (the Montreal Protocol, 1987) to discontinue both production and use of all Halons due to evidence that Halons contribute to the depletion of stratospheric ozone. This development has led to a search for alternative, environmentally innocuous agents that act in a similar manner to Halons for the suppression and extinction of fire, but without the ozone-depleting effects.

The search for alternatives to Halon-1301 has focused in large part on agents that closely mimic the chemical, physical, and fluid mechanical properties of $CF_3Br$, particularly other halocarbon systems. Concerns about the effects of bromine on ozone depletion potential (ODP) narrowed this search to fluorocarbons or hydrogenated fluorocarbons, e.g. HFC-227 and HFC-125. However, these compounds were observed to be much less effective per unit mass or volume with respect to Halon 1301. There has been some recent attention directed towards the use of $CF_3I$ as an alternative agent. However, its efficacy is hampered by concerns regarding high altitude emissions. Comparisons of pure inert gas (e.g., bottled nitrogen or carbon dioxide) are also quite unfavorable with respect to Halon-1301, due in particular to the large volumes required for agent storage of these compressed gases.

A class of "superagents" has long been known, which exhibit fire suppression effectiveness much greater than Halon-1301. The foremost example of these agents is iron pentacarbonyl, $Fe(CO)_5$, but other examples include chromyl chloride, $CrO_2Cl_2$, and tetraethyl lead, $Pb(C_2H_5)_4$, as well as powdered materials such as $K_3Fe(CN)_6$. However, while effective at suppressing fires, these superagents are toxic, and are therefore less useful in general suppression applications.

An alternative approach to fire suppression has been based upon technology similar to that used in automobile airbag devices. In this approach, the fire suppression agent is a mixture of inert gases which are stored in the form of solid propellants. Upon combustion in a solid propellant gas generator (SPGG), these solids produce large quantities of nitrogen, carbon dioxide, and water vapor. The compact nature of the SPGG device makes it an efficient means for storing gas-generating agents in a solid form. For a solid propellant formulation which yields 50% gas, volumes required for agent storage approach that of Halon-1301; high-efficiency propellant formulations meet both mass and volume envelopes of Halon systems.

Functioning of a SPGG fire suppression device is quite similar to that of more conventional bottle blowdown systems in that both begin with electronic squib initiation. In the case of SPGG's, a squib initiates the combustion of solid propellant grain or grains, which may be present in granular form (e.g. the size of sand particles), the form of pills similar in size to aspirin tablets, or larger tablets (e.g., sized like a salami). The propellant formulation, containing an intimate mixture of fuel and oxidizer plus additives, rapidly combusts to generate large amounts of inert gas and water vapor. The inert gas blend is then exhausted into the fire zone to effect suppression. In practice, this type of fire extinguishing composition generates large amounts of inert gases $CO_2$, $N_2$, and $H_2O$, which together act to quench flames through a combination of cooling, dilution and flame strain.

The advantages of SPGG units for fire suppression are many. In a SPGG, the fire suppression agent is stored at atmospheric pressure in hermetically sealed units, both contributing to long service lifetimes. Upon combustion, the gases can be produced in timeframes ranging from about 50 ms to several seconds, and the devices are operable over a wide range of temperatures. In addition, the generated gaseous agents ($N_2$, $CO_2$, $H_2O$) are chemically benign and pose no threat to atmospheric ozone. However, despite its effectiveness, the use of this fire extinguishing composition is limited in several scenarios, e.g., aircraft drybays, where undesirable bay overpressures arise from the large volumes of gas at elevated temperatures, and is not weight competitive in other cases where, e.g., the higher thermal loads arising from propellant combustion must be offset by sufficient thermal mass.

Additional fire extinguishing approaches are described in the following U.S. Patents.

U.S. Pat. No. 4,601,344, "Pyrotechnic Fire Extinguishing Compounds" by Reed, Jr. et al. issued Jul. 22, 1986.

U.S. Pat. No. 5,113,947, "Fire Extinguishing Methods and Compositions Utilizing 2-chloro-1,1,1,2-tetrafluoroethane" by Robin issued May 19, 1992.

U.S. Pat. No. 5,117,917, "Fire Extinguishing Methods Utilizing Perfluorocarbons" by Robin et al. issued Jun. 2, 1992.

U.S. Pat. No. 5,124,053, "Fire Extinguishing Methods and Blends Utilizing Hydrofluorocarbons" by Iikubo et al. issued Jun. 23, 1992.

U.S. Pat. No. 5,423,384, "Apparatus for Suppressing a Fire" by Galbraith et al. issued Jun. 13, 1995.

U.S. Pat. No. 5,465,795, "Fire Suppression Apparatus for Generating Steam from a Water-Ice Mixture" by Galbraith et al. issued Nov. 14, 1995.

U.S. Pat. No. 5,609,210, "An Apparatus and Method for Suppressing a Fire" by Galbraith et al. issued Mar. 11, 1997.

U.S. Pat. No. 5,613,562, "An Apparatus for Suppressing a Fire" by Galbraith et al. issued Mar. 25, 1997.

U.S. Pat. No. 5,756,006, "Flame Extinguishing Pyrotechnic and Explosive Composition" by Reed et al. issued May 26, 1998.

Additionally, workers at the National Institute of Standards and Technology (Babushok, V.; Tsang, W.; Linteris, G. T.; Reinelt, D. Comb. Flame 1998, Vol. 115, 551–560) have explored the chemical limits to flame inhibition, comparing the chemical kinetics of hydrocarbon flames in the presence of Halon-1301 and various superagents, and examined the reaction rates in light of measured extinction concentration data.

In view of the above, there exists a need for alternatives to Halons, particularly alternatives that are environmentally innocuous and which meet the mass/weight requirements and size restrictions for confined spaces. The present invention is believed to be an answer to that need.

SUMMARY OF THE INVENTION

In one aspect, the present invention is directed to a fire suppression composition, comprising a propellant comprising a fuel and an oxidizer, the propellant capable of generating inert gas; and a fire suppression additive selected from the group consisting of iron-containing compounds, non-halide potassium salts, and combinations thereof.

In another aspect, the present invention is directed to a fire suppression composition, comprising a propellant comprising from about 5 to about 50% by weight of a fuel and from about 20 to about 90% by weight of an oxidizer, the propellant capable of generating inert gas; and from about 1 to about 25% by weight of a fire suppression additive selected from the group consisting of ferric oxide, ferric carbonate, ferric oxalate, ferric chloride, ferric sulfate, ferric bromide, ferric iodide, ferric sulfonate, ferric ferrocyanide, potassium ferrocyanide, ammonium ferrocyanide, ferrous oxide, ferrous chloride, ferrous bromide, ferrocene, iron pentacarbonyl, iron nonacarbonyl, ferric acetylacetone, iron phthalocyanine, iron acetate, potassium acetate, potassium acetylacetonate, potassium bicarbonate, potassium carbonate, potassium hexacyanoferrate, potassium hydroxide, potassium pentane dionate, potassium oxalate, and combinations thereof.

In another aspect, the present invention is directed to an apparatus for suppressing a fire, comprising: a gas generator containing a fire suppression composition, comprising a propellant comprising from about 5 to about 50% by weight of a fuel and from about 20 to about 90% by weight of an oxidizer, the propellant capable of generating inert gas; and from about 1 to about 25% by weight of a fire suppression additive selected from the group consisting of ferric oxide, ferric carbonate, ferric oxalate, ferric chloride, ferric sulfate, ferric bromide, ferric iodide, ferric sulfonate, ferric ferrocyanide, potassium ferrocyanide, ammonium ferrocyanide, ferrous oxide, ferrous chloride, ferrous bromide, ferrocene, iron pentacarbonyl, iron nonacarbonyl, ferric acetylacetone, iron phthalocyanine, iron acetate, potassium acetate, potassium acetylacetonate, potassium bicarbonate, potassium carbonate, potassium hexacyanoferrate, potassium hydroxide, potassium pentane dionate, potassium oxalate, and combinations thereof; and a passageway between the gas generator and the fire.

In another aspect, the present invention is directed to an apparatus and fire suppressant composition for suppressing a fire, comprising: (a) a first container containing a propellant comprising a fuel and an oxidizer, the fuel comprising from about 5 to about 50% by weight of the composition, the oxidizer comprising from about 20 to about 90% by weight of the composition, the propellant capable of generating inert gas; (b) a second container connected to the first container by a passageway, the second container containing a fire suppression additive selected from the group consisting of ferric oxide, ferric carbonate, ferric oxalate, ferric chloride, ferric sulfate, ferric bromide, ferric iodide, ferric sulfonate, ferric ferrocyanide, potassium ferrocyanide, ammonium ferrocyanide, ferrous oxide, ferrous chloride, ferrous bromide, ferrocene, iron pentacarbonyl, iron nonacarbonyl, ferric acetylacetone, iron phthalocyanine, iron acetate, potassium acetate, potassium acetylacetonate, potassium bicarbonate, potassium carbonate, potassium hexacyanoferrate, potassium hydroxide, potassium pentane dionate, potassium oxalate, and combinations thereof; the fire suppression additive comprising from about 1 to about 25% by weight of the total composition; and (c) an outlet between the second container and the fire.

These and other aspect will be described in more detail in the following detailed description of the invention.

BRIEF DESCRIPTION OF THE DRAWINGS

The invention will be more fully understood from the following detailed description taken in conjunction with the accompanying drawings in which.

DETAILED DESCRIPTION OF THE INVENTION

Figure 1:
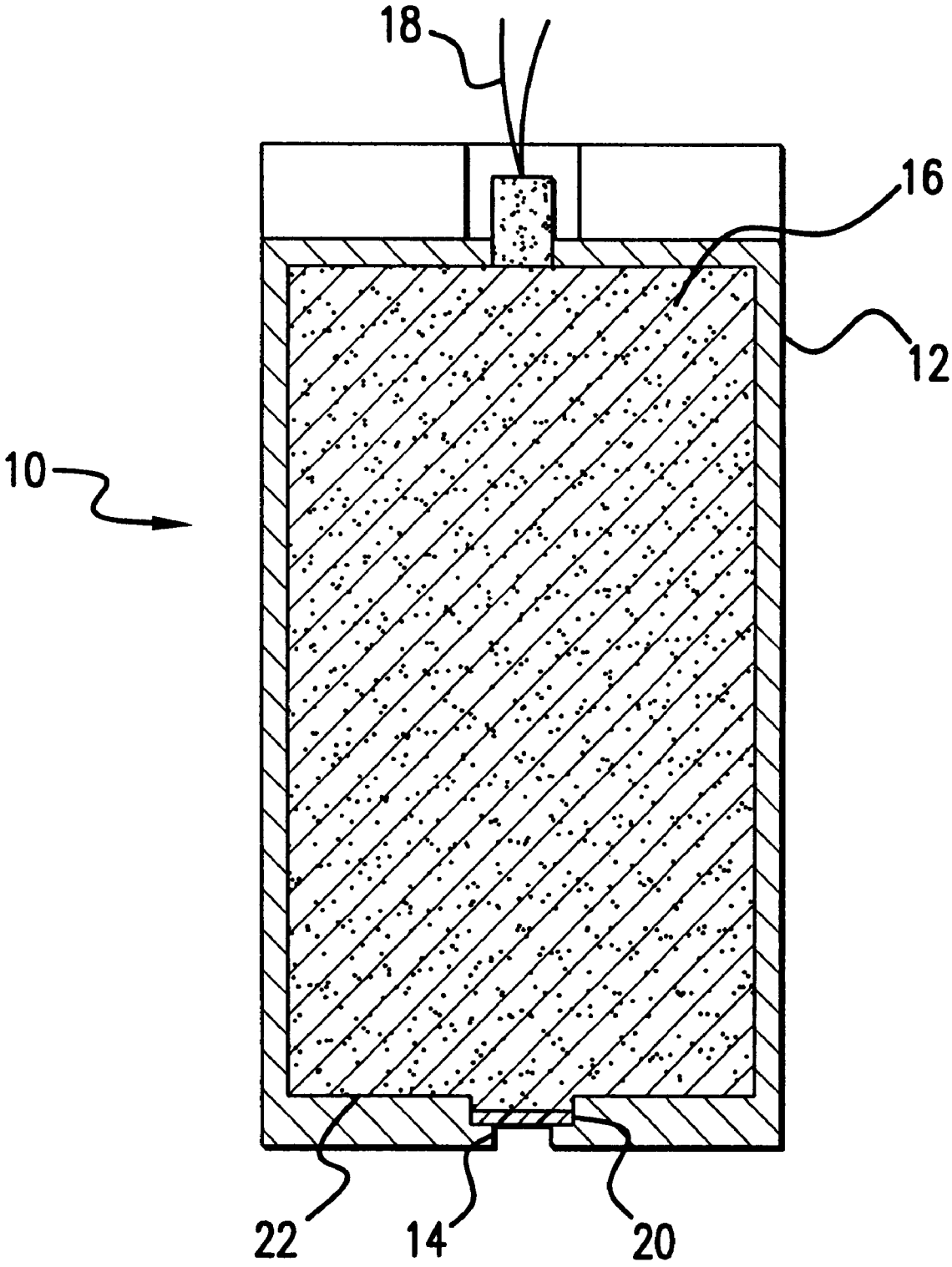
FIG. 1 is a schematic diagram of an apparatus useful with the composition of the invention.

It has now been surprisingly found that addition of an iron containing species and/or a non-halide potassium salt significantly decreases thermal loads, overpressure considerations, and corrosion and toxicity concerns in applications using solid propellant gas generator fire suppression systems. In particular, addition of an iron containing species and/or a non-halide potassium salt to propellant-based fire extinguishing compositions is more effective than potassium iodide, KI, in fire suppression tests performed using the turbulent spray burner (TSB) subscale test fixture. The compositions of the present invention are readily transferable to non-propellant based suppression approaches, e.g., powders, liquids and gaseous agents.

As indicated above, the present invention is a fire suppression composition comprising (1) a propellant comprising a fuel and an oxidizer, the propellant capable of generating inert gas; and (2) a fire suppression additive selected from the group consisting of iron-containing compounds, non-halide potassium salts, and combinations thereof. Each of these components is discussed in detail below.

The propellant component of the invention is preferably a propellant which produces large amounts of inert gases such as carbon dioxide ($CO_2$), nitrogen ($N_2$), and water vapor ($H_2O$) when ignited. Such propellants useful in the composition of the invention generally comprise energetic fuels in combination with oxidizers. Exemplary energetic fuels include 5-aminotetrazole or potassium, zinc, or other salts thereof, bitetrazole or potassium, zinc or other salts thereof, diazoaminotetrazole or potassium, zinc, or other salts thereof, diazotetrazole dimer and its salts, guanidine nitrate, aminoguanidine nitrates, nitroguanidine, triazoles (e.g., 5-nitro-1,2,4-triazol-3-one), triaminoguanidinium and diaminoguanidinium salts, and combinations thereof. Exemplary oxidizers include alkali metal nitrates (e.g., $NaNO_3$), alkaline earth nitrates (e.g., $Sr(NO_3)_2$, phase-stabilized ammonium nitrates (PSAN), perchlorates, iodates, and bromates.

The fuel component of the composition preferably comprises from about 5 to about 50% by weight of the total composition, and more preferably from about 10 to about 35% by weight of the total composition. The oxidizer component of the composition preferably comprises from about 20 to about 90% by weight of the total composition, and more preferably, from about 25 to about 50% by weight of the total composition. The relative amounts of fuel and oxidizer in the propellant range from about 30% fuel and 70% oxidizer, to about 70% fuel to about 30% oxidizer, all based on the total weight of the propellant.

The propellant component of the fire suppression composition generates large amounts of inert gases which function to physically extinguish the fire by the combined effects of straining the burning flame front, displacing oxygen available for combustion, and reducing the heat of the combustion source. According to the invention, approximately about 40–100 grams of inert gases can be produced from approximately 100 grams of solid propellant. The generated inert gases act as a carrier for the pyrotechnically generated chemically reactive species produced on combustion of the chemically-acting fire suppression component.

The fire suppression additive component of the composition of the invention is an iron-containing compound, a non-halide potassium salt, or a combination of these. In general, these compounds are thought to generate environmentally innocuous fire suppressive reactive species that disrupt combustion processes, and upon combustion of the propellant and oxidizer, the fire suppression additive is vaporized and swept into the fire by the gas stream.

Iron containing species that are useful in the fire suppression additive component of the invention include ferric oxide, ferrocyanide salts, derivatives such as Milori blue, iron carbonyl and iron salts such as carbonates and oxalates. Exemplary iron containing compounds include ferric oxide, ferric carbonate, ferric oxalate, ferric chloride, ferric sulfate, ferric bromide, ferric iodide, ferric sulfonate, ferric ferrocyanide, potassium ferrocyanide, ammonium ferrocyanide, ferrous oxide, ferrous chloride, ferrous bromide, ferrocene, iron pentacarbonyl, iron nonacarbonyl, ferric acetylacetone, iron phthalocyanine, iron acetate and iron cyanide dyes such as Milori Blue (ammonium ferroferricyanide, $NH_4Fe_2(CN)_6$) and Prussian Blue (ferric ferrocyanide, $Fe_4(Fe(CN_6)_3)$ Suitable non-halide potassium compounds include potassium carbonate, potassium tetrazole and triazole salts such as potassium 5-aminotetrazole (K5AT) and potassium nitrotriazolone (KNTO). Exemplary potassium compounds include potassium acetate, potassium acetylacetonate, potassium bicarbonate, potassium carbonate, potassium hexacyanoferrate, potassium hydroxide, potassium pentane dionate, and potassium oxalate. In general, non-halide potassium salts are non-toxic to humans in most forms.

The fire suppressing additive preferably comprises from about 1% to about 25% by weight, based on the total weight of the composition. A preferred amount of the fire suppressing additive is from about 1% to about 10% by weight. Additionally, the fire suppressing additive is preferably in particulate form having a mean particle diameter of from about 1 micron to about 100 microns and preferably from about 1 micron to about 50 microns. Since the particulate is not necessarily spherical, "diameter" is intended to convey the average straight line distance from a point on one side of the particulate, through the geometric center to an opposing point on an opposing side of the particulate. Most preferred is potassium carbonate in range of particle sizes from about 1 micron to about 50 microns.

While the fire suppressing additive is particularly described as being added to a solid propellant, it is within the scope of the invention to add the fire suppressing additive to other fire suppressing compositions, such as dry chemical powders, water-based agents, fluorocarbon-based agents and flame retardant materials.

The above fire suppressing additives offer several advantages over the halon-based fire suppressive chemicals. Unlike Halons, the fire suppressing additives of the present invention are mainly environmentally innocuous salts which are not volatile. Accordingly, these fire suppressing additives are not subjected to high altitude photolysis and therefore do not contribute to ozone destruction. Additionally, the fire suppressing additives may be reformed to their environmentally innocuous parent salts. These salts may be washed away by rain or water applied by firefighting personnel. The composition of the invention also offers the following advantages over prior art fire suppression compositions: increased fire suppression effectiveness; decreased toxicity; decreased corrosivity; greater versatility; applicability to powdered fire suppression agents; applicability to liquid fire suppression agents; and applicability to gaseous fire suppression agents.

The composition may include other additives to enhance the fire suppression capability. Coolants, such as magnesium carbonate ($MgCO_3$) or magnesium hydroxide ($Mg(OH)_2$) may be added to further reduce the combustion temperature and enhance fire suppression efficiency. Coolants preferably comprise from about 0 to about 40% by weight of the total composition, and more preferably from about 5 to about 35% by weight of the total composition.

Optionally, binders such as thermoplastic rubbers, polyurethanes, polycarbonates, polysuccinates, polyethers, and the like may also be added to the composition. Binders act to hold the active materials together when the propellant is in its finished form. Plasticizers and processing aids may also be added to the composition to enhance processing. Generally, binders, plasticizers, or processing aids are optionally present in the composition from about 0–15% by weight, based on the total weight of the composition.

The composition results in production of fire suppressive agents that do not have an adverse impact on the environment. The gases produced from the propellant component are all nonhazardous, nonflammable, and comprise significant fractions of the natural atmosphere. The fire suppressing additives also produce nonhazardous, water soluble species that do not destroy atmospheric ozone. In addition, in the event of accidental discharge, the fire suppressing additives may be easily washed out of the atmosphere by normal precipitation.

The combination of energetic fuel and oxidizer in the propellant component of the composition advantageously allows for large volumes of inert gas to be produced from relatively small volumes of solid propellant material. As a result, more compact fire extinguishing device may be employed. Use of compact fire extinguishing devices is particularly desirable in applications where space is limited, for example automobiles, space vehicles, commercial or military aircraft or ships, submarines, or treaded vehicles such as tanks. Compact fire extinguishing devices may also be used in cargo spaces, closed electronic cabinets, paint or ammunition lockers, or any other confined space.

The fire suppression composition of the invention may be generally prepared by combining appropriate amounts of fuel, oxidizer, and fire suppressing additives along with optional ingredients such as coolants, binders, or plasticizers. These ingredients are mixed to produce a homogeneous blend of particles, or may be done in an aqueous medium, such as water, to form an aqueous solution or slurry. The homogeneous blend may be compacted into pellets or compressed into a storage vessel of a fire extinguishing apparatus using conventional compaction techniques known in the art.

Alternatively, the composition of the invention may be utilized as a unitary composition (e.g., all ingredients in one mixture), or as a binary composition (e.g., one or more ingredients in a first subcomposition, and one or more ingredients in a second subcomposition). In one embodiment, described in more detail below with respect to FIG. 2, a binary composition can include a first subcomposition comprising the fuel and oxidizer in a first container, and a second subcomposition comprising the fire suppression additive in a second container. The first container and the second container are linked so that the fuel and oxidizer ignite and generate gases that are transferred to the second container containing the fire suppressive additive composition. The fire suppressive additive composition, in turn, is vaporized by the hot gases from the fuel and oxidizer, and the combination of gases are sprayed onto the fire.

In the binary composition embodiment described above, the fire suppressive additive may be in solid form, or may comprise a portion of a liquid or slurry media. Useful liquid or slurry media include water, or fluorocarbons known in the propellant art, such as HFC-125 (pentafluoroethane), HFC-227 (heptafluoropropane), and the like.

The composition of the invention may be used as a replacement for commercially available fire suppression agents that act exclusively as physically-acting agents or environmentally hazardous chemically-acting agents.

FIG. 1 is a schematic diagram of a fire extinguishing apparatus useful with the composition of the invention. As shown in FIG. 1, the apparatus 10 includes a gas generator 12 and a passageway 14 attached to the bottom 22 of the gas generator 12. The fire suppression composition of the invention 16 is placed in interior of the gas generator 12. In this particular embodiment, the fire suppression composition 16 includes a propellant made from a fuel and an oxidizer, and fire suppressing additives. As described above, the propellant generates inert gases to physically smother the fire, while the fire suppressing additives generate fire suppressive reactive species upon combustion to extinguish the fire chemically.

An electric initiator 18 is attached to the top of the gas generator 12 to ignite the fire suppression composition 16 when a fire is detected. After ignition, the fire suppressive gases are generated inside the gas generator 12. As these gases are generated, pressure inside the gas generator 12 increases to a point at which the seal 20 attached to the bottom 22 of the gas generator 12 is broken and the fire suppressive gases are released onto the fire.

Figure 2:
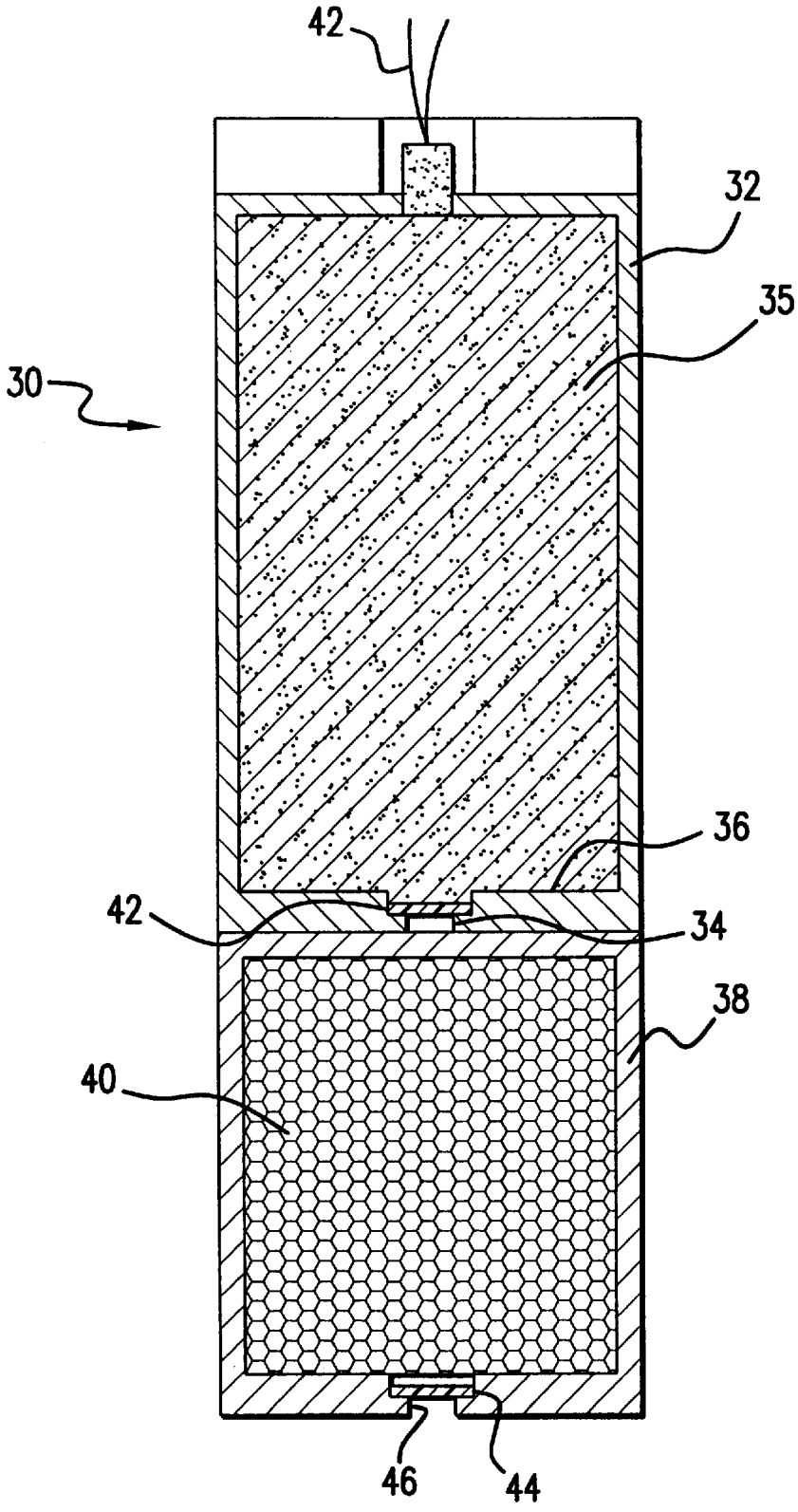
FIG. 2 is a schematic diagram of another apparatus useful with the composition of the invention.

FIG. 2 shows an alternative embodiment of a fire extinguishing apparatus useful with the composition of the invention. In this exemplary embodiment, the apparatus 30 includes a gas generator 32 containing the propellant component 35 of the fire suppression composition, and a passageway 34 attached to the bottom 36 of the gas generator 30. This passageway 34 is attached to a secondary container 38 that contains a bed 40 that includes the fire suppression additive, as well as optional ingredients such as one or more coolants. The bed 40 that contains the fire suppressive additive may be solid (e.g., packed fire suppressive additive in combination with binders, coolants, etc. as described above), an aqueous solution or slurry (e.g., a water solution of fire suppressive additive), or non-aqueous solution or slurry (e.g., a combination of fire suppressive additive and fluorocarbons known in the propellant art, such as HFC-125 (pentafluoroethane), HFC-227 (heptafluoropropane), and the like).

An electric initiator 42 is attached to the top of the gas generator 32 to ignite the propellant component 35 when a fire is detected. After ignition, the propellant component 35 generates hot, physically-acting fire suppressive gases that build pressure within the gas generator 32. The built-up pressure breaks a seal 42 positioned over the passageway 34, and permits the hot, physically-acting fire suppressive gases to pass through the passageway 34 and enter the secondary container 38. Once inside the secondary container 38, the hot, physically-acting fire suppressive gases volatilize the fire suppression additive component 40 and any optional coolants to produce a combination of physically-acting fire suppressive gases and chemically-acting fire suppressive gases. The coolant keeps the hot gases within a specified temperature range, preferably 1500° F. or lower. The pressure of the volatilized fire suppression additive gases raises the total pressure within the secondary container 38 and causes a secondary seal 44 to break, thereby releasing the combination of physically-acting and chemically-acting fires suppressive gases through the outlet 46 and onto the fire.

The combination of physically acting fire suppression agents and chemically acting, environmentally innocuous fire suppression additives results in a highly effective, environmentally innocuous fire extinguishing composition that has low ozone depletion potential (ODP), low global warming potential (GWP), and high suppression efficiency.

The invention is further described by the following Examples, but is not intended to be limited by the Examples. All parts and percentages are by weight and all temperatures are in degrees Celsius unless explicitly stated otherwise.

EXAMPLES

Example 1

A solid propellant composition, consisting of 17.2% 5-aminotetrazole, 30.0% strontium nitrate, 31.5% magnesium carbonate, and 21.3% ferric oxide was prepared by ball-milling the solid ingredients together and compression molding into tablets. These tablets were combusted within a gas generator at pressures of ~1000–3000 psi and exhausted into an airstream and carried into a burning jet-fuel/air fire. The mixture of gas and solid exhaust species from the propellant combustion quickly extinguished these fires, the propellant serving to volatilize the iron oxide and entrain it in a gas stream which delivers it to the fire where, at flame temperatures, it generates sufficient combustion terminators that combustion is quenched.

Example 2

A solid propellant composition, consisting of 2.7% Kraton elastomer (a binder), 23.13% nitroguanidine and 64.17% phase stabilized ammonium nitrate (85/15 AN/KN) and 10% Milori Blue (ammonium ferroferricyanide, $NH_4Fe_2CN_6$) was prepared by ball-milling the solid ingredients together and compression molding into tablets. These tablets were combusted within a gas generator at pressures of ~1000–3000 psi and exhausted into an airstream and carried into a burning jet-fuel/air fire. On combustion the Milori Blue is converted into iron oxides. The mixture of gas ($CO_2$, $N_2$, $H_2O$) and solid ($K_2O$, $Fe_2O_3$) exhaust species from the propellant combustion quickly extinguished these fires, the propellant serving to entrain solids in a gas stream and deliver them to the fire where, at flame temperatures, the $K_2O$ and iron oxides generate sufficient combustion terminators that combustion is quenched.

Example 3

A powdered composition, consisting of 90% potassium bicarbonate (Purple K) and 10% ferric oxalate was prepared by ball-milling the solid ingredients together. This powder was then delivered to an airstream and carried into a burning jet fuel/air fire. On delivery to the fire, flame temperatures are sufficient to converted ferric oxalate into iron oxides, and the potassium bicarbonate into potassium oxides, and the metal oxide combustion terminators subsequently quenched combustion.

Example 4

An aqueous solution of potassium carbonate (10 grams per 100 ml solution) and iron acetate (10 grams per 100 ml solution) was prepared and held in the lower container as shown in FIG. 2. The propellant composition described in Examples 1 and 2 was prepared and held in the upper container shown in FIG. 2. Under pressure generated by the propellant mixture, the potassium carbonate/iron acetate agent was directed at a petroleum-air fire. On contact, the water-potassium carbonate-iron oxalate solution was vaporized as the water evaporates, thus cooling the fire. The fire also decomposed the potassium and iron compounds, forming potassium and iron oxide species which interrupted hydrocarbon combustion processes resulting in extinction of the fire.

Example 5

A mixture of HFC-125 (pentafluorethane) and bis (cyclopentadienyl)iron(ferrocene), 100 g/10 g respectively, was prepared using standard gas/vacuum line techniques and installed in the lower container as shown in FIG. 2. A propellant composition as described above was installed in the upper container shown in FIG. 2. The pentafluorethane and bis(cyclopentadienyl)iron(ferrocene) mixture was volatilized by the ignited propellant and delivered to a fire directly where the iron compound was rapidly decomposed, forming ultrafine particles of iron oxide. The iron oxide species acts to terminate the hydrocarbon combustion process by intercepting combustion radicals and removing them from the flame zone, thus extinguishing the fire.

While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims. All patent applications, patents, and other publications cited herein are incorporated by reference in their entireties.

What is claimed is:

1. A fire suppression composition, comprising:

a propellant comprising a fuel and an oxidizer, said propellant capable of generating inert gas; and a fire suppression additive comprising a non-halide potassium salt selected from the group consisting of potassium acetate, potassium acetylacetonate, potassium hexacyanoferrate, potassium pentane dionate, potassium oxalate, and combinations thereof.

2. The fire suppression composition of claim 1, wherein said fire suppression additive comprises from about 1 to about 25% by weight of said composition.

3. The fire suppression composition of claim 1, wherein said inert gas comprises water, carbon dioxide, and nitrogen.

4. The fire suppression composition of claim 1, further comprising an additional ingredient selected from the group consisting of coolants, binders, and combinations thereof.

5. The fire suppression composition of claim 4, wherein said coolant is $MgCO_3$.

6. The fire suppression composition of claim 1, wherein said fire suppression additive further comprises one or more iron-containing compounds.

7. The fire suppression composition of claim 6, wherein said iron-containing compounds are selected from the group consisting of ferric oxide, ferric carbonate, ferric oxalate, ferric chloride, ferric sulfate, ferric bromide, ferric iodide, ferric sulfonate, ferric ferrocyanide, potassium ferrocyanide, ammonium ferrocyanlde, ferrous oxide, ferrous chloride, ferrous bromide, ferrocene, iron pentacarbonyl, iron nonacarbonyl, ferric acetylacetone, iron phthalocyanine, iron acetate, iron cyanide dyes, and combinations thereof.

8. The fire suppression composition of claim 1, wherein said fuel is selected from the group consisting of 5-aminotetrazole or a salt thereof, bitetrazole or salts thereof, diazoaminotetrazole or salts thereof, diazotetrazole dimer or salts thereof, guanidine nitrate, aminoguanidine nitrates, nitroguanidine, 5-nitro-1,2,4-triazol-3-one, triaminoguanidinium, diaminoguanidinium, and combinations thereof.

9. The fire suppression composition of claim 8, wherein said fuel comprises from about 5 to about 50% by weight of said composition.

10. The fire suppression composition of claim 9, wherein said fuel comprises from about 10 to about 35% by weight of said composition.

11. The fire suppression composition of claim 1, wherein said oxidizer is selected from the group consisting of alkali metal nitrates, alkaline earth nitrates, phase stabilized ammonium nitrates, perchlorates, iodates, bromates, and combinations thereof.

12. The fire suppression composition of claim 11, wherein said oxidizer comprises from about 20 to about 90% by weight of said composition.

13. The fire suppression composition of claim 12, wherein said oxidizer comprises from about 25 to about 50% by weight of said composition.

14. A fire suppression composition, comprising:

a propellant comprising from about 5 to about 50% by weight of a fuel and from about 20 to about 90% by weight of an oxidizer, said propellant capable of generating inert gas;

from about 1 to about 25% by weight of a fire suppression additive selected from the group consisting of, ferric oxide, ferric carbonate, ferric oxalate, ferric chloride, ferric sulfate, ferric bromide, ferric iodide, ferric sulfonate, ferric ferrocyanide, potassium ferrocyanide, ammonium ferrocyanide, ferrous oxide, ferrous chloride, ferrous bromide, ferrocene, iron pentacarbonyl, iron nonacarbonyl, ferric acetylacetone, iron phthalocyanine, iron acetate, iron cyanide dyes, potassium acetate, potassium acetylacetonate, potassium hexacyanoferrate, potassium pentane dionate, potassium oxalate, and combinations thereof; and from about 5 to about 35 wt % of magnesium carbonate as a coolant.

15. The fire suppression composition of claim 14, wherein said fuel is selected from the group consisting of 5-aminotetrazole or a salt thereof, bitetrazole or salts thereof, diazoaminotetrazole or salts thereof, diazotetrazole dimer or salts thereof, guanidine nitrate, aminoguanidine nitrates, nitroguanidine, 5-nitro-1,2,4-triazol-3-one, triaminoguanidinium, diaminoguanidinium, and combinations thereof.

16. The fire suppression composition of claim 14, wherein said oxidizer is selected from the group consisting of alkali metal nitrates, alkaline earth nitrates, phase stabilized ammonium nitrates, perchlorates, iodates, bromates, and combinations thereof.

17. The fire suppression composition of claim 14, wherein said fuel comprises from about 10 to about 35% by weight of said composition.

18. The fire suppression composition of claim 14, wherein said oxidizer comprises from about 25 to about 50% by weight of said composition.

* * * * *